US010770082B2

(12) United States Patent
Ekstrand et al.

(10) Patent No.: US 10,770,082 B2
(45) Date of Patent: Sep. 8, 2020

(54) AUDIO DECODER AND METHOD FOR TRANSFORMING A DIGITAL AUDIO SIGNAL FROM A FIRST TO A SECOND FREQUENCY DOMAIN

(71) Applicant: Dolby International AB, Amsterdam Zuidoost (NL)

(72) Inventors: Per Ekstrand, Saltsjobaden (SE); Robin Thesing, Nuremberg (DE); Lars Villemoes, Järfälla (SE)

(73) Assignee: Dolby International AB, Amsterdam Zuidoost (NL)

( * ) Notice: Subject to any disclaimer, the term of this patent is extended or adjusted under 35 U.S.C. 154(b) by 69 days.

(21) Appl. No.: 16/307,624

(22) PCT Filed: Jun. 20, 2017

(86) PCT No.: PCT/EP2017/065011
§ 371 (c)(1),
(2) Date: Dec. 6, 2018

(87) PCT Pub. No.: WO2017/220528
PCT Pub. Date: Dec. 28, 2017

(65) Prior Publication Data

US 2019/0251978 A1 Aug. 15, 2019

Related U.S. Application Data

(60) Provisional application No. 62/353,241, filed on Jun. 22, 2016.

(30) Foreign Application Priority Data

Jun. 22, 2016 (EP) ..... 16175715

(51) Int. Cl.
*G10L 19/02* (2013.01)
*G10L 21/0388* (2013.01)
*G10L 19/008* (2013.01)

(52) U.S. Cl.
CPC ..... *G10L 19/02* (2013.01); *G10L 19/008* (2013.01); *G10L 21/0388* (2013.01); *G10L 19/0212* (2013.01)

(58) Field of Classification Search
CPC ... G10L 19/02; G10L 19/008; G10L 21/0388; G10L 19/0212
See application file for complete search history.

(56) References Cited

U.S. PATENT DOCUMENTS 7,009,533 B1 * 3/2006 Wegener ..... H04N 1/413 341/76
7,685,218 B2 * 3/2010 McGrath ..... G11B 20/10037 708/313

(Continued)

FOREIGN PATENT DOCUMENTS

WO 2005/025229 3/2005
WO 2005/078600 8/2005

(Continued)

OTHER PUBLICATIONS

Hsu, Han-Wen et al., "Audio Patch Method in MPEG-4 HE-AAC Decoder", Audio Engineering Society, AES, 6221, Oct. 28, 2004 to Oct. 31, 2004, San Francisco, CA,USA, p. 2, right hand column—p. 3, Left hand column.

(Continued)

*Primary Examiner* — Yogeshkumar Patel

(57) ABSTRACT

There is provided an audio decoder and a method therein for transforming a digital audio signal from a first frequency domain to a second frequency domain. For each received frame of the digital audio signal, the method identifies an upper limit of the frequency range, and if the upper limit of (Continued)

the frequency range is below the Nyquist frequency of said frame of the digital audio signal by more than a threshold amount, the Nyquist frequency of said frame of the digital audio signal is lowered from its original value to a reduced value by removing spectral bands of said frame of the digital audio signal above the identified upper limit of the frequency range. Thereafter said frame of the digital audio signal is transformed from the first frequency domain to the second frequency domain via an intermediate time domain.

20 Claims, 6 Drawing Sheets

(56) References Cited

U.S. PATENT DOCUMENTS

2002/0154696 A1* 10/2002 Tardif ..... G06T 3/4084 375/240.16
2004/0100588 A1* 5/2004 Hartson ..... H04N 7/08 348/608
2004/0138874 A1* 7/2004 Kaajas ..... G10L 21/038 704/205
2005/0053152 A1* 3/2005 Raveendran ..... H04N 19/154 375/240.21
2007/0225971 A1* 9/2007 Bessette ..... G10L 19/265 704/203
2009/0319283 A1* 12/2009 Schnell ..... H03H 17/0266 704/503
2010/0023322 A1* 1/2010 Schnell ..... G10L 19/0204 704/211
2012/0046772 A1* 2/2012 Dickins ..... G10L 19/025 700/94
2013/0188692 A1* 7/2013 Chiu ..... H04N 19/154 375/240.03
2013/0238343 A1* 9/2013 Schnell ..... H03H 17/0266 704/500
2014/0314238 A1* 10/2014 Usher ..... H04R 3/04 381/17
2015/0049880 A1* 2/2015 Villemoes ..... H03H 17/0266 381/98
2015/0149158 A1* 5/2015 Ekstrand ..... G10H 1/0091 704/205
2015/0287417 A1* 10/2015 Disch ..... G10L 19/032 704/500
2016/0035329 A1* 2/2016 Ekstrand ..... G10L 21/038 381/61
2016/0050420 A1* 2/2016 Helmrich ..... G10L 19/0212 375/240.24
2016/0078875 A1* 3/2016 Helmrich ..... H04N 19/176 704/501
2016/0140973 A1* 5/2016 Neukam ..... G10L 19/032 704/200.1
2017/0140768 A1* 5/2017 Fuchs ..... G10L 19/025
2017/0148462 A1* 5/2017 Lohwasser ..... H03H 17/0211
2017/0256267 A1* 9/2017 Disch ..... G10L 19/028

FOREIGN PATENT DOCUMENTS

WO 2010/129709 11/2010
WO 2010/136429 12/2010
WO 2012/020090 2/2012
WO 2013/124443 8/2013
WO 2015/010948 1/2015
WO 2016/016123 2/2016

OTHER PUBLICATIONS

Khalil, H. et al "DCT of Spatially Adaptive Subsampled Interframes for Image Sequence Coding" IEEE International Conference on Image Processing, Dec. 1, 1996, pp. 391-394.

* cited by examiner

AUDIO DECODER AND METHOD FOR TRANSFORMING A DIGITAL AUDIO SIGNAL FROM A FIRST TO A SECOND FREQUENCY DOMAIN

TECHNICAL FIELD

The present invention relates to the field of audio coding. In particular, it relates to transformation of a digital audio signal from a first frequency domain to a second frequency domain in an audio decoder.

BACKGROUND

In audio coding systems it is common to exploit different properties of different filter banks for different encoding and decoding steps. For example, a modified discrete cosine transform (MDCT) may be used for encoding the waveform of a digital audio signal prior to transmittal from the encoder to the decoder, and a quadrature mirror filter (QMF) bank may be used for high frequency and spatial synthesis of the digital audio signal in the decoder. In such case, the digital audio signal has to be transformed from a first frequency domain associated with a first filter bank or transform to a second domain associated with a second filter bank or transform in the decoder.

There are systems which, in connection to transforming a digital audio signal from one frequency domain to another, sub-sample the digital audio signal in order to reduce the size of the transforms. This is possible for band-limited digital audio signals and reduces the computational complexity. For example, the High-Efficiency Advanced Audio Coding (HE-AAC) codec operates in a dual rate mode in which the transforms are sub-sampled by a factor of two. Another example is given in US2016035329 A1, where sub-sampling of the digital audio signal is used in order to decrease computational complexity. In these systems the factor by which the transforms are sub-sampled is constant, and does hence not adapt to variations in the digital audio signal. There is thus room for improvements.

BRIEF DESCRIPTION OF THE DRAWINGS

In what follows, example embodiments will be described in greater detail and with reference to the accompanying drawings, on which.

DETAILED DESCRIPTION

Figure 1:
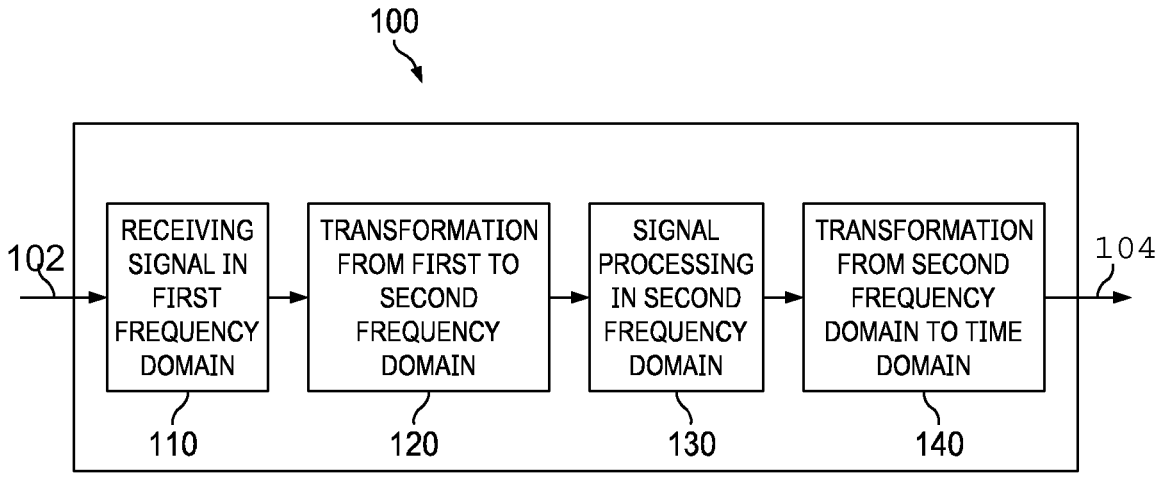
FIG. 1 illustrates an audio decoder according to embodiments.

In view of the above it is an object to provide a method and an audio decoder which efficiently and adaptively transforms a digital audio signal from a first frequency domain to a second frequency domain

I. Overview

According to a first aspect, this object is achieved by a method in an audio decoder for transforming a digital audio signal from a first frequency domain to a second frequency domain, comprising:

receiving subsequent frames of a digital audio signal being represented in a first frequency domain, the digital audio signal having a Nyquist frequency which is half of an original sampling rate of the digital audio signal, for each frame of the digital audio signal:

identifying a frequency range of the digital audio signal by analyzing spectral contents of the digital audio signal, if the frequency range is below the Nyquist frequency by more than a threshold amount, lowering the Nyquist frequency of the digital audio signal from its original value to a reduced value by removing spectral bands of the digital audio signal above the identified frequency range, transforming the digital audio signal from the first frequency domain to a second frequency domain via an intermediate time domain, wherein the digital audio signal has a sampling rate in the intermediate time domain which is reduced in relation to the original sampling rate by a sub-sampling factor defined by a ratio between the original value of the Nyquist frequency and the reduced value of the Nyquist frequency, and appending spectral bands to the digital audio signal in the second frequency domain above the reduced value of the Nyquist frequency so as to restore the Nyquist frequency to its original value.

With this arrangement, a decision is taken on a frame-by-frame basis as to whether the Nyquist frequency should be reduced or not. For each frame, the decision is taken on basis of the frequency range of the digital audio signal in the frame. If the frequency range is below the Nyquist frequency by more than a threshold amount, i.e. if the digital audio signal is found to be band-limited in the frame, a decision is taken to reduce the Nyquist frequency. In this way the method may adapt to the frequency content in each frame of the digital audio signal.

If a decision is taken in a frame to reduce Nyquist frequency, the Nyquist frequency is reduced from its original value to a reduced value by removing spectral bands above the frequency range identified with respect to the frame. As a result, computational complexity is reduced since the removed spectral bands are omitted in the process of transforming the digital audio signal from the first frequency domain to the second frequency domain via an intermediate time domain. In other words, the size of the transforms may be reduced by the sub-sampling factor, thereby making the transformations less computationally demanding. Moreover, since the frequency range may vary between frames, and the reduced value of the Nyquist frequency depends on the frequency range, the method allows for different reduced values of the Nyquist frequency in different frames. In this way, the method may further adapt to variations in frequency contents between frames.

Reduction of the Nyquist frequency in the frequency domain corresponds to sub-sampling of the digital audio signal in the time domain. The reduction of the Nyquist frequency thus has the effect that the digital audio signal will be sub-sampled when transformed to the time domain. In particular, the factor by which the digital audio signal is sub-sampled in the time domain is given by the ratio between the original value of the Nyquist frequency and the reduced value of the Nyquist frequency.

The first frequency domain may generally be associated with a first time-to-frequency transform. The second frequency domain may generally be associated with a second time-to-frequency transform. The first frequency transform may be associated with a first filter bank and the second frequency domain may be associated with a second filter bank.

The digital audio signal is associated with a sampling rate. The Nyquist frequency is half the sampling rate of the digital audio signal. This is the highest frequency of the original audio signal which may be represented in its digital version. The Nyquist frequency is thus the highest frequency on the frequency scale for the representation of the digital audio signal in the first frequency domain.

The digital audio signal may be received at the decoder in frames. A frame of the digital audio signal represents a temporal portion of predefined duration of the digital audio signal.

By frequency range is typically meant the bandwidth or the highest frequency having non-zero spectral contents of the digital audio signal.

By spectral contents is generally meant the values or coefficients of the digital audio signal for the different spectral bands in a frequency domain representation of the digital audio signal.

By spectral band is meant a frequency interval in a frequency domain representation of the digital audio signal.

By frequency domain representation is typically meant the coefficients or subband samples constituting the output of a time-to-frequency domain transform or filter bank. The terms transform or filter bank are used interchangeably in the present disclosure.

As discussed above, the reduced value of the Nyquist frequency may vary between frames. This means that the method may switch from one reduced value of the Nyquist frequency to another reduced value of the Nyquist frequency when going from one frame to the next frame. In particular, the reduced value of the Nyquist frequency of a current frame may be set depending on the reduced value of the Nyquist frequency of a previous frame in relation to the frequency range of the current frame. For example, depending on whether the frequency range of the current frame is above or below the reduced value of the Nyquist frequency in a previous frame, the reduced value of the Nyquist frequency may be increased or decreased, respectively. This allows the decision on how to adjust the reduced value of the Nyquist frequency to be made in a sequential manner.

According to example embodiments, the reduced value of the Nyquist frequency of the current frame is set to be larger than the reduced value of the Nyquist frequency of the previous frame (i.e., the Nyquist frequency is increased) if the frequency range of the current frame exceeds the reduced value of the Nyquist frequency of the previous frame by more than a threshold amount. Increasing the reduced value of the Nyquist frequency under these circumstances is preferred in order to prevent artifacts such as aliasing and bandwidth truncation. Typically the threshold amount is set to zero, such that the reduced value of the Nyquist frequency is always increased if the bandwidth increases beyond the reduced value of the Nyquist frequency from a previous frame. By a frequency range exceeding a reduced value of the Nyquist frequency is meant that the highest frequency in the frequency range exceeds the reduced value of the Nyquist frequency.

It may also be the case that the highest frequency of the frequency range of a current frame is similar to the reduced value of the Nyquist frequency of the preceding frame. In that case, the method may decide to keep the reduced value of the Nyquist frequency from the preceding frame, since no (or little) artifacts would be introduced and/or little would be gained, in terms of computational complexity, by adjusting the reduced value of the Nyquist frequency. (In fact, a switch to another reduced value of the Nyquist frequency could in this situation, in the worst case, lead to an increase in computational complexity since re-sampling of the digital audio signal in the time domain would be needed as will be further explained below). In more detail, the reduced value of the Nyquist frequency of the current frame is set to be equal to the reduced value of the Nyquist frequency of the previous frame if a highest frequency of the frequency range of the current frame differs from the reduced value of the Nyquist frequency of the previous frame by no more than a threshold amount.

In case that the frequency range of the current frame is significantly lower (as defined by a threshold amount) than the reduced valued of the Nyquist frequency of the preceding frame, it may be beneficial, for reasons of computational complexity, to decrease the reduced value of the Nyquist frequency when going from the preceding frame to the current frame (i.e., the Nyquist frequency is further decreased). In particular, the reduced value of the Nyquist frequency of the current frame may be set to be lower than the reduced value of the Nyquist frequency of the previous frame if the frequency range of the current frame is below the reduced value of the Nyquist frequency of the previous frame by more than a threshold amount. The threshold amount may for example correspond to 20% of the reduced value of the Nyquist frequency of the previous frame.

It may be undesirable, however, if the reduced value of the Nyquist frequency changes too often between frames. Depending on the specific implementation of the sub-sampling described below, this could lead to undesirably high computational complexity and/or audible artifacts. Preferably, the method always increases the reduced value of the Nyquist frequency from a previous to a current frame if the frequency range of the next frame exceeds the reduced value of the Nyquist of the previous frame by more than a threshold amount. This is for the reason of avoiding audible artifacts such as limiting the spectral contents.

However, when decreasing the reduced value of the Nyquist frequency from a previous to a current frame, one may also take the frequency range of a predefined number of previous frames into account. For this purpose, the reduced value of the Nyquist frequency of the current frame may further be set depending on the frequency range of a predefined number of previous frames. In this way, one may avoid situations in which the reduced value of the Nyquist frequency is unnecessarily adjusted in each and every frame.

For example, there may be a requirement that the frequency range has remained essentially the same throughout a number of frames. Thus, the reduced value of the Nyquist frequency of the current frame may be set to be lower than the reduced value of the Nyquist frequency of the previous frame if, additionally, the absolute values of the differences between the frequency range of the current frame and each of a predefined number of previous frames are each no more than a threshold amount.

Alternatively, or additionally, there may be a requirement that the frequency range of a number of previous frames has stayed below the reduced value of the Nyquist frequency of the frame preceding the current frame. In more detail, the reduced value of the Nyquist frequency of the current frame may be set to be lower than the reduced value of the Nyquist frequency of the previous frame if, additionally, the frequency range of each of a predefined number of previous frames is below the reduced value of the Nyquist frequency of the previous frame by more than a threshold amount.

These requirements may thus result in smoother transitions of the reduced value of the Nyquist frequency between frames.

The threshold amounts referred to above may all be different and are typically pre-defined in the decoder.

Adapting the reduced value of the Nyquist frequency (and thereby the sub-sampling ratio) from frame to frame poses a challenge to transforms that rely on time domain samples from previous frames. This is, in particular, the case if transformation of the digital audio signal from the first frequency domain to the intermediate time domain or from the intermediate time domain to the second frequency domain requires intermediate time domain samples of the digital audio signal from a previous frame, in addition to intermediate time domain samples of the digital audio signal from a current frame.

The change of the transform size results in a change of the sampling rate of the intermediate time domain samples that are decoded from the current frame. These do not match the sampling rate of intermediate time domain samples from previous frames that are still stored in the system, and which need to be combined with the intermediate time domain samples of the current frame for further joint processing. According to example embodiments, this problem is solved by re-sampling the time domain samples from the previous frame(s). Specifically, the method may comprise checking if the reduced value of the Nyquist frequency is different in the current frame and the previous frame so as to identify if the intermediate time domain samples of the digital audio signal in the current and the previous frame have different sampling rates, and if so, re-sampling of the intermediate time domain samples of the previous frame such that the intermediate time domain samples in the current frame and the previous frame have the same sampling rate.

Re-sampling only happens in the transition frame(s), i.e. for adjacent frames being associated with different reduced values of the Nyquist frequency (i.e., different sub-sampling ratios). The re-sampling is no longer necessary when the switch to the new reduced value of the Nyquist frequency has been completed.

Sub-sampled operation of the transforms may introduce a temporal delay in the system. In more detail, the output signal of the decoder at sub-sampled operation (when the Nyquist frequency has been reduced) may be delayed with respect to the output signal of the decoder when operating at the original sampling rate. This is undesirable, since, optimally, one would like the output signal of the decoder to be the same regardless of whether the transforms operate at the original sampling rate or at a reduced sampling rate (i.e., regardless of whether the Nyquist frequency has its original value or a reduced value). Otherwise, there may be audible artifacts. The temporal delay is due to a temporal misalignment of filters (sometimes referred herein as windows) of a first bank of filters used to transform the digital audio signal from the first frequency domain to the intermediate time domain, and filters of a second bank of filters used to transform the digital audio signal from the intermediate time domain to the second frequency domain. For example there would be a misalignment of an even-symmetric inverse MDCT window and an odd-symmetric QMF window. The re-sampling of the intermediate time domain samples of the previous frame may comprise compensating for this temporal delay. If no such compensation is carried out there may be audible artifacts in the audio output of the decoder.

Generally, the temporal delay may be compensated for by temporally shifting the time domain samples of the previous frame by a delay value when re-sampling. The temporal delay which is compensated for in the re-sampling of the intermediate time domain samples of the previous frame is given by a value $d_{fract,1}$ which depends on a ratio $q_1$ between the sub-sampling factors of the current frame and the previous frame, respectively, according to $$d_{fract,1}=(q_1-1)/2.$$

The re-sampling of the intermediate time domain samples of the previous frame(s) may be carried out in different ways. If a re-sampling of high quality is desired, interpolation and finite impulse response (FIR) filtering followed by decimation may be used. An alternative is to re-sample the intermediate time domain samples of the previous frame using interpolation, such as linear or cubic spline interpolation. This results in a lower quality but has a very low computational complexity. By quality is in this context meant that the output signal of the decoder at sub-sampled operation of the transforms is similar to the output signal of the decoder when the transforms operate at the original sampling rate.

Generally, the first frequency domain may be associated with a first bank of synthesis filters having a first, predetermined, length, and the second frequency domain is associated with a second bank of analysis filters having a second, predetermined, length. The first filter bank is associated with a first transform size being equal to the number of filters in the first filter bank, which in turn corresponds to the number of frequency bands, or channels, of the corresponding transform. Similarly, the second filter bank is associated with a second transform size being equal to the number of filters in the second filter bank, which in turn corresponds to the number of frequency bands, or channels, of the corresponding transform. The first filter bank and the second filter bank are intended to work at the original sampling rate. That is, the first and the second filter bank are designed to transform the digital audio signal from the first frequency domain to the second frequency domain via an intermediate time domain, wherein the sampling rate in the intermediate time domain is the original sampling rate. The transform sizes and the predetermined length of the filters are in this way associated with the original sampling rate (and the original value of the Nyquist frequency) of the digital audio signal. However, as the Nyquist frequency is reduced, the sampling rate is reduced by the sub-sampling factor. As a consequence, there is a need for transforms or filter banks which operate at reduced sampling rates. The first and second filter banks which are associated with the original sampling frequency may be taken as a starting point for providing transforms or filter banks which operate at reduced sampling rates.

To start with, the reduction of the Nyquist frequency by removal of spectral bands implies that the sizes, i.e., the number of spectral bands or frequency channels, of the first and second filter banks may be reduced by the sub-sampling factor. This is possible since the removed spectral bands may be omitted in the process of transforming the digital audio signal from the first frequency domain to the second frequency domain via an intermediate time domain.

Moreover, since the reduction of the Nyquist frequency leads to a reduction of the sampling rate, the length of the filters in the first and the second filter banks may be reduced to match the reduced sampling rate. Therefore, the step of transforming the digital audio signal from the first frequency domain to a second frequency domain via an intermediate time domain may comprise: reducing the length of the synthesis filters of the first bank by the sub-sampling factor and using the synthesis filters of reduced length when transforming the digital audio signal from the first frequency domain to the intermediate time domain, and/or reducing the length of the analysis filters of the second bank by the sub-sampling factor and using the analysis filters of reduced length when transforming the digital audio signal from the intermediate time domain to the second frequency domain. In this way, the synthesis and analysis filters of the first and the second bank, respectively, may be adapted to the reduced sampling rate corresponding to the reduced value of the Nyquist frequency.

The first and the second bank may be modulated filter banks. In that case, the first filter bank may be associated with a first prototype filter from which the synthesis filters of the first bank may be derived. Further, the second filter bank may be associated with a second prototype filter from which the analysis filters of the second bank may be derived. In case of modulated filter banks, the lengths of the synthesis filters and the analysis filters may be reduced by first reducing the length of the respective prototype filters, and then deriving synthesis and analysis filter from the prototype filters of reduced length.

There are different ways of reducing the length of the synthesis filters and the analysis filters of the first and the second bank, respectively. For example, if closed form expressions are available, these may be used to re-calculate filters having a reduced length. Alternatively, or if closed form expressions are not available, the filters may be downsampled in order to reduce their length. In particular, the length of the synthesis filters of the first bank may be reduced by downsampling by the downsampling factor or by re-calculating the synthesis filters from a closed form expression describing the synthesis filters of the first bank. Further, the length of the analysis filters of the second bank may be reduced by downsampling by the downsampling factor or by re-calculating the analysis filters from a closed form expression describing the analysis filters of the second bank.

In case of modulated filter banks, the length of the prototype filters may be reduced by the downsampling factor by downsampling or by re-calculation from a closed form expression.

In order to prevent audible artifacts, the downsampling of the synthesis filters of the first bank and/or the analysis filters of the second bank may comprise compensating for a temporal delay being due to a temporal misalignment of the synthesis filters of the first bank, and the analysis filters of the second filter bank, as described above. This temporal misalignment leads to a mismatch between the sub-sampled grids of the first and the second bank relative to the original sampling grid to be compensated for. Generally, the temporal delay may be compensated for by temporally shifting the synthesis or analysis filter (or their prototype), as applicable, by a delay value when downsampling.

As an alternative to compensating for the temporal delay when downsampling the filters, the temporal delay may be compensated for after transforming the digital audio signal to the second frequency domain. In more detail, the method may comprise applying a phase-shift to the digital audio signal after the step of transforming the digital audio signal from the first frequency domain to a second frequency domain via an intermediate time domain, wherein the phase-shift depends on a temporal delay being due to a temporal misalignment of the synthesis filters of the first bank, and the analysis filters of the second filter bank. This delay compensation introduces an inaudible albeit small phase error in the audio output of the decoder.

The temporal delay compensated for when downsampling of the synthesis filters of the first bank and/or the analysis filters of the second bank, or when adding a phase shift to the digital audio signal in the second frequency domain, is given by a value $d_{fract,2}$ which depends on the sub-sampling factor according to $d_{fract,2}=(q_2-1)/2$, where $q_2$ is the sub-sampling factor (of the frame).

For reasons of saving computational complexity, the synthesis filters in the first bank and/or the analysis filters in the second bank may be downsampled using linear or cubic spline interpolation.

According to exemplary embodiments the first frequency domain may be a modified discrete cosine transform (MDCT) domain, and the second frequency domain may be a quadrature mirror filter (QMF) domain.

The frequency range (or rather its upper limit), i.e. the bandwidth, of the digital audio signal is typically determined as the highest frequency having a non-zero spectral content in the spectrum of the digital audio signal as represented in the first frequency domain. However, according to example embodiments, the method may further comprise receiving parameters relating to the digital audio signal, wherein the frequency range is further identified based on the parameters. For example, the parameters may relate to a frequency threshold above which spectral contents of the digital audio signal will be reconstructed based on spectral contents below the frequency threshold (e.g. using high frequency reconstruction techniques, such as spectral band replication). The frequency range (or rather the upper limit of the frequency range) may then be set to the frequency threshold. The reduced value of the Nyquist frequency may be selected to be equal to the highest frequency of the identified frequency range. In such embodiments, the step of lowering the Nyquist frequency of the digital audio signal from its original value to the reduced value comprises removing all spectral bands of the digital audio signal above the identified frequency range.

However, for the sake of efficient implementation, only a limited set of sub-sampling factors (and thereby a limited set of reduced values of the Nyquist frequency) may be supported. This limited set of sub-sampling factors is typically designed such that the sub-sampling factors result in transform sizes which can be implemented efficiently (e.g. power-of-two size FFTs). Preferably, there are pre-programmed transforms or filter banks corresponding to the sub-sampling factors in the set. In this way, one may avoid having to downsample or re-calculate the filters upon switching from one reduced value of the Nyquist frequency to another.

In detail, the step of lowering the Nyquist frequency of the digital audio signal may therefore comprise: selecting, from a predefined set of values, a reduced value of the Nyquist frequency as the lowest value in the predefined set being above the identified frequency range, and removing spectral bands of the digital audio signal above the selected reduced value of the Nyquist frequency.

In cases where the digital audio signal is a multi-channel signal, i.e., comprises a plurality of audio channels, the decision on if and how to lower the Nyquist frequency is made on a channel basis. Specifically, the steps of identifying a frequency range of the digital audio signal and lowering the Nyquist frequency are performed for each audio channel, thereby allowing different audio channels to have different reduced values of the Nyquist frequency in the same frame.

According to a second aspect, there is provided a computer program product comprising a (non-transitory) computer-readable medium having computer code instructions stored thereon for carrying out the method of any one of the preceding claims when executed by a device having processing capability.

According to a third aspect, there is provided an audio decoder for transforming a digital audio signal from a first frequency domain to a second frequency domain, comprising:

a receiving component configured to receive subsequent frames of a digital audio signal being represented in a first frequency domain, the digital audio signal having a Nyquist frequency which is half of an original sampling rate of the digital audio signal, and a transformation component configured to, for each frame of the digital audio signal:

identify a frequency range of the digital audio signal by analyzing spectral contents of the digital audio signal, if the frequency range is below the Nyquist frequency by more than a threshold amount, lower the Nyquist frequency of the digital audio signal from its original value to a reduced value by removing spectral bands of the digital audio signal above the identified frequency range, transform the digital audio signal from the first frequency domain to a second frequency domain via an intermediate time domain, wherein the digital audio signal has a sampling rate in the intermediate time domain which is reduced in relation to the original sampling rate by a sub-sampling factor defined by a ratio between the original value of the Nyquist frequency and the reduced value of the Nyquist frequency, and append spectral bands to the digital audio signal in the second frequency domain above the reduced value of the Nyquist frequency so as to restore the Nyquist frequency to its original value.

The second and the third aspects may generally have the same features and advantages as the first aspect.

II. Example Embodiments

FIG. 1 schematically illustrates an audio decoder 100. The audio decoder 100 comprises a receiving component 110, a first transformation component 120, a signal processing component 130, and a second transformation component 140.

When in use, the receiving component 110 receives an (encoded) digital audio signal 102. The digital audio signal 102 is received in temporally subsequent frames. The digital audio signal 102 as received at the receiving component 110 is associated with a sampling rate, herein referred to as the original sampling rate. The original sampling rate is the inverse of the temporal distance between subsequent temporal samples of the digital audio signal 102.

The digital audio signal 102 may comprise different audio channels. It is to be understood that the methods described herein may be applied to each of the audio channels of the digital audio signal 102 separately or in any combinations. For example, some audio channels may be parametrically coded such that spectral contents are added to higher frequencies by parametric tools which operate in the second frequency domain. When such parametric tools are in use, the bandwidth of the audio channel as represented in the first frequency domain is typically limited to half of the Nyquist frequency or lower, which allows cutting the transform size by a factor of two or more. As another example, the low frequency effects (LFE) audio channel is band-limited to a few hundred Hz by definition allowing for even more aggressive sub-sampling by a factor of 8 or even 16. Different audio channels may thus have different bandwidth properties. By treating the audio channels separately, different audio channels may be subject to sub-sampling by different factors in order to achieve maximum reduction of computational complexity.

The digital audio signal 102 as received at the decoder 100 is typically not represented in the time domain, but rather in a frequency domain. For example, for reasons of efficient transmission from an encoder to the decoder, the digital audio signal 102 may at the encoder have been transformed to a first frequency domain by application of a filter bank of analysis filters, such as an MDCT or another filter bank found suitable for that purpose. Thus, upon receipt, the digital audio signal 102 is represented in a first frequency domain, i.e., as a collection of frequency domain samples which describe the spectral contents of the digital audio signal 102 for different frequency bands. According to fundamental digital signal processing, the maximum frequency of the representation of the digital audio signal 102 in the first frequency domain is given by the Nyquist frequency which is half of the original sampling rate of the digital audio signal 102.

The digital audio signal 102 is then passed along to the first transformation component 120 which is configured to transform the digital audio signal 102 from the first frequency domain representation to a second frequency domain representation. The reason for transforming from one frequency domain representation to another is that the different frequency domain representations may be associated with different advantages. For example, the first frequency domain representation may be preferred for encoding the wave-form of the digital audio signal 102 and sending it from the encoder to the decoder 100, while a second frequency domain representation may be preferred for processing and synthesis of the digital audio signal 102 in the decoder 100, e.g. for purposes of parametric reconstruction. The second frequency domain may be a QMF domain.

The digital audio signal 102 is then passed along from the first transformation component 120 to the signal processing component 130, where various processing of the digital audio signal 102 is carried out in the second frequency domain. For example, the signal processing component 130 may carry out parametric reconstruction including high frequency reconstruction as known in the art.

The resulting signal from the signal processing component 130 is then transformed from the second frequency domain to the time domain by the second transformation component 140 in order to produce an output signal 104 for subsequent playback.

Figure 3:
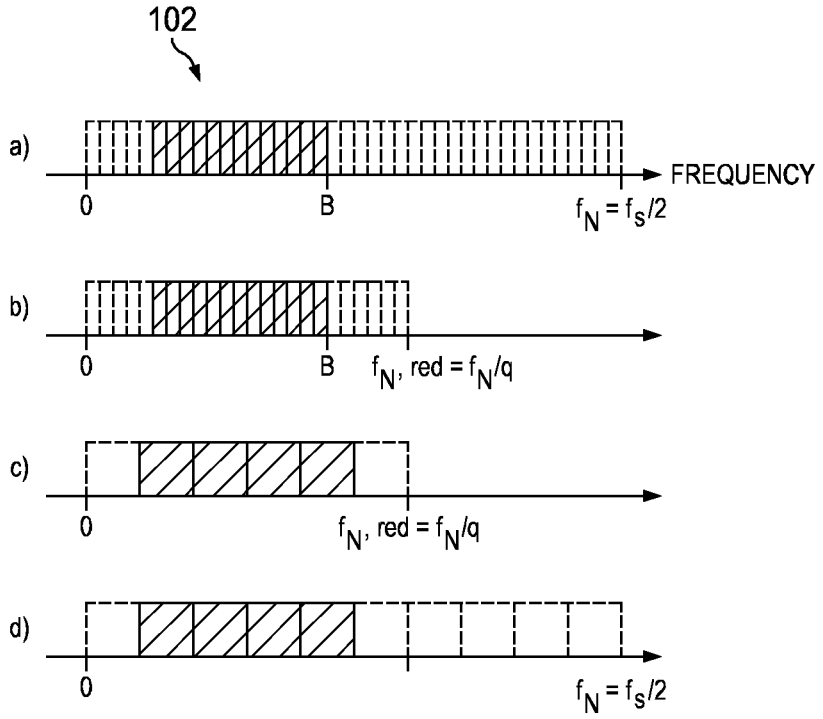
FIG. 3 illustrates the spectrum of a digital audio signal during different steps of the method of FIG. 2.

The general structure of the audio decoder 100 is similar to that of prior art decoders. However, the audio decoder 100 differs from prior art decoders in the functionality of the first transformation component 120. In order to reduce computational complexity, the first transformation component 120 implements a method which adaptively, that is, on a frame-by-frame basis, allows the size of the transforms (from first frequency domain to time domain, and from time domain to second frequency domain) to vary. This is achieved by adapting the Nyquist frequency in each frame to the bandwidth of the digital audio signal 102 in the frame by omitting (typically empty) spectral bands of the digital audio signal 102 above the bandwidth. From a time domain perspective, this corresponds to sub-sampling the digital audio signal 102 and the transforms on a frame-by-frame basis. The operation of the first transformation component 120 will be described in more detail in the following with reference to FIGS. 1 and 3 and the flow chart of FIG. 2.

Figure 2:
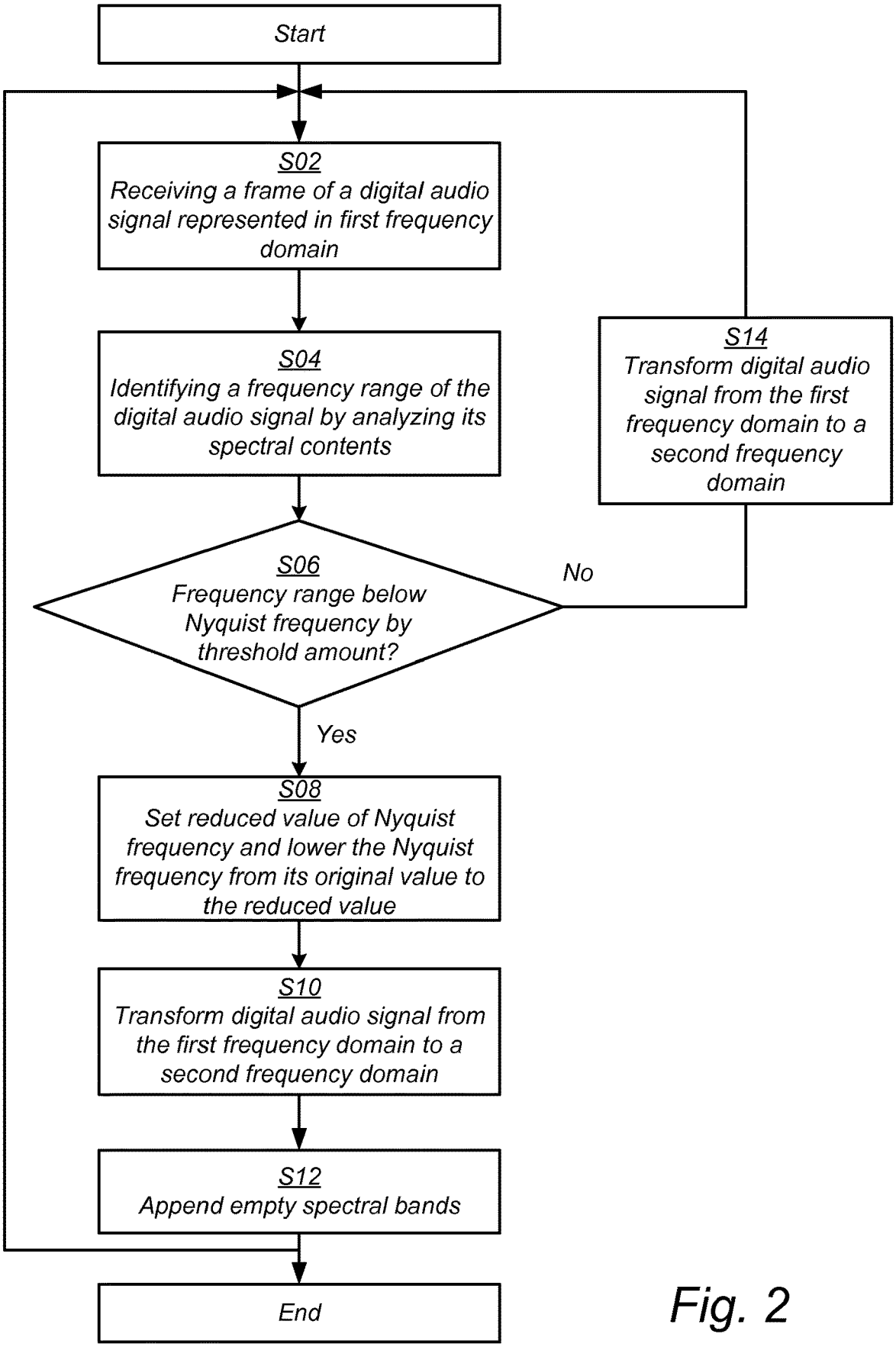
FIG. 2 is a flowchart of a method for transforming a digital audio signal from a first to a second frequency domain according to embodiments.

In step S02 of FIG. 2, the transformation component 120 receives, from the receiving component 110 of decoder 100, a frame of the digital audio signal 102 represented in the first frequency domain. According to example embodiments, the first digital audio signal 102 is given in the form of a MDCT spectrum. The receiving component 110 has in turn received the frame of the digital audio signal 102 from an encoder.

In step S04, the transformation component 120 identifies a frequency range of the digital audio signal 102. The frequency range is identified by analyzing spectral contents of the digital audio signal 102. This is further illustrated in FIG. 3*a*, which illustrates a frame of the digital audio signal 102 represented in the first frequency domain. The dashed bins correspond to spectral bands having non-zero spectral contents. The highest frequency represented is the Nyquist frequency $f_N$ which is half of the original sampling rate $f_s$ the digital audio signal 102, i.e. $f_N=f_S/2$. The transformation component 120 may typically determine the frequency range as the bandwidth B of the digital audio signal 102, i.e., as the highest frequency having a non-zero spectral content in the spectrum. However, there are example embodiments in which the frequency range is further determined on basis of received parameters which relate to the digital audio signal 102. For instance, the parameters may relate to a frequency threshold above which spectral contents of the digital audio signal will be reconstructed, by the signal processing component 130, based on spectral contents below the frequency threshold (e.g. using high frequency reconstruction techniques, such as spectral band replication). In such cases, the frequency range (or rather the upper limit of the frequency range) may be set to the frequency threshold. According to another example, the parameters may relate to a frequency threshold above which spectral contents of one audio channel of the digital audio signal 102 will be reconstructed, by the signal processing component 130, based on spectral contents from another audio channel of the digital audio signal. In such cases, the frequency range (or rather the upper limit of the frequency range) may be set to that frequency threshold.

Next, in step S06, the transformation component 120 checks whether the frequency range is below the Nyquist frequency $f_N$ by more than a predefined amount.

If not, it is found that it would not be possible to sub-sample the digital audio signal 102 without limiting the bandwidth or introducing aliasing artifacts. The transformation component 120 therefore proceeds to transform, step S14, the digital audio signal 102 without reducing the Nyquist frequency. In other words, the transformation component 120 will operate as prior art systems, i.e., at the original sampling rate. In order to do so, the transformation component 120 may first transform the audio signal 102 from the first frequency domain representation to an intermediate time domain representation by using a first bank of synthesis filters, such as an inverse MDCT filter bank. The first filter bank is associated with a first (predetermined) transform size corresponding to the number of filters in the bank (this is the number of frequency sub-bands or channels of the transform). Further, the filters (sometimes referred to as windows) of the first bank have a predetermined length. After transformation using the first filter bank, the digital audio signal 102 is represented in the intermediate time domain and has its original sampling rate.

This is then followed by transforming the audio signal 102 from the intermediate time domain representation to the second frequency domain representation using a second bank of analysis filters, such as a QMF filter bank. The second filter bank is associated with a second (predetermined) transform size corresponding to the number of filters in the bank (this is the number of frequency sub-bands or channels of the transform). Further, the filters (sometimes referred to as windows) of the second bank have a predetermined length. The first and the second filter banks and the filters therein are thus intended to operate at the original sampling frequency. For example, the first bank may correspond to a MDCT transform of size 2048 with a filter length of 4096, and the second bank may correspond to a QMF bank of size 64 with a filter length of 640.

Preferably, the first and the second filter banks are modulated filter banks. A modulated filter bank has a prototype filter from which the filters in the filter bank may be derived.

After having completed step S14, the transformation component 120 returns to step S02 where a subsequent frame of the digital audio signal is received.

If it instead is found in step S06 that the frequency range is below the Nyquist frequency $f_N$ by a predefined amount, the transformation component proceeds to step S08.

In step S08, the transformation component 120 sets a reduced value $f_{N,red}$ of the Nyquist frequency. In order to avoid aliasing or reducing the bandwidth, the reduced value of the Nyquist frequency should be equal to, or above, the highest frequency in the frequency range. For example, the reduced value of the Nyquist frequency may be selected to be equal to the highest frequency of the identified frequency range, which in the example of FIG. 3*a* is the bandwidth B. However, for the sake of efficient implementation only a limited set of reduced values of the Nyquist frequency may be supported, wherein the limited set of reduced values e.g. is given in terms of the original Nyquist frequency divided by a set of sub-sampling factors. By way of example, the set of sub-sampling factors may comprise the sub-sampling factors 1, 4/3, 2, 4, 8 and 16. The transformation component 120 may therefore select the largest possible sub-sampling factor from the set of sub-sampling factors which still give a reduced value of the Nyquist frequency being above the identified frequency range of the digital audio signal 102. Alternatively, the transformation component 120 may select the lowest value of the limited set of reduced values of the Nyquist frequency which exceeds the identified frequency range of the digital audio signal 102.

Generally, the transformation component 120 may lower the value of the Nyquist frequency from its original value $f_N$ to the reduced value $f_{N,red}$ by removing spectral bands of the digital audio signal 102 above the identified frequency range. This is further illustrated in FIG. 3*b*, where spectral bands above the frequency range are removed such that the highest frequency in the spectrum becomes the reduced value $f_{N,red}$ of the Nyquist frequency. From a time domain perspective, this corresponds to sub-sampling the digital audio signal 102 by the sub-sampling factor, i.e. by $f_N/f_{N,red}$.

Having lowered the Nyquist frequency to the reduced value, the transformation proceeds to transform the digital audio signal 102 from the first frequency domain (which e.g. is a MDCT domain) to a second frequency domain (which e.g. is a QMF domain) via an intermediate time domain. This is further illustrated in FIG. 3*c*, which illustrates the digital audio signal 102 represented in a second (sub-sampled) frequency domain. Since the Nyquist frequency has been lowered, the transformation component 120 may work with reduced transform sizes. In particular, the transform sizes may be reduced by the sub-sampling factor compared to operation at the original sampling rate. In this way, the computational complexity is reduced. Thus, instead of using the first and second filter banks operating at the original sample rate, as described above in connection to step S14, the transformation component 120 may use a first filter bank of reduced transform size for transformation from the first frequency domain to the intermediate time domain, and a second filter bank of reduced transform size for transformation from the intermediate time domain to the second frequency domain.

For this purpose, the transformation component 120 may calculate and store filter banks intended to operate at different sampling rates, i.e. at different values of the sub-sampling factors. These filter banks may be re-used each time the different sub-sampling factors are selected. In this way computational complexity may be reduced. Preferably, the transformation component 120 only supports a limited set of sub-sampling factors. In this way the computational effort for calculating filters or transform windows of different sizes is minimized or completely eliminated by having pre-stored filter coefficients or windows in non-volatile memory.

In order to calculate first and second filter banks of reduced transform size which corresponds to a particular sub-sampling factor, the transformation component 120 may take the first and the second filter banks operating at the original sampling rate as a starting point.

First, the transform size needs to be reduced, meaning that the number of synthesis filters in the first filter bank of full size is reduced by the sub-sampling factor, and that the number of analysis filters in the second filter bank of full size is reduced by the sub-sampling factor. The transform size reduction is achieved by removing filters from the first and second filter banks which correspond to spectral bands that were removed from the digital audio signal 102 in step S08.

Secondly, the lengths of the filters in the first and the second banks need to be adjusted in view of the reduced sampling rate. The transformation component 120 may therefore reduce the length of the synthesis filters of the first bank, and the length of the analysis filters of the second bank by the sub-sampling factor.

This may be done in different manners. In case there is a closed form expression describing the synthesis filters of the first bank and/or a closed form expression describing the analysis filters of the second bank, these closed-form expressions may be used to re-calculate filters of reduced length.

Alternatively, or if closed form expressions are not available, the length of the filters may be reduced by downsampling by the sub-sampling factor. For example, the filters may be downsampled using interpolation, such as linear interpolation or cubic spline interpolation.

The calculation of first and second filter banks corresponding to a sub-sampling factor is facilitated in case modulated filter banks are used. In that case, the prototype filters of the first and the second filter banks of full size, respectively, may, after modification, be used to derive corresponding first and second filter banks for sub-sampled operation. For this purpose, the transformation component 120 may first reduce the length of the synthesis prototype filter of the first filter bank of full size by the sub-sampling factor by either downsampling by the sub-sampling factor or by re-calculating a synthesis prototype filter of reduced length from a closed form expression as described above. Then, the synthesis prototype filter of reduced length may be used to derive the first filter bank of reduced transform size corresponding to the sub-sampling factor. The same applies to the analysis prototype filter of the second filter bank in connection to deriving a second filter bank of reduced transform size.

Figure 4:
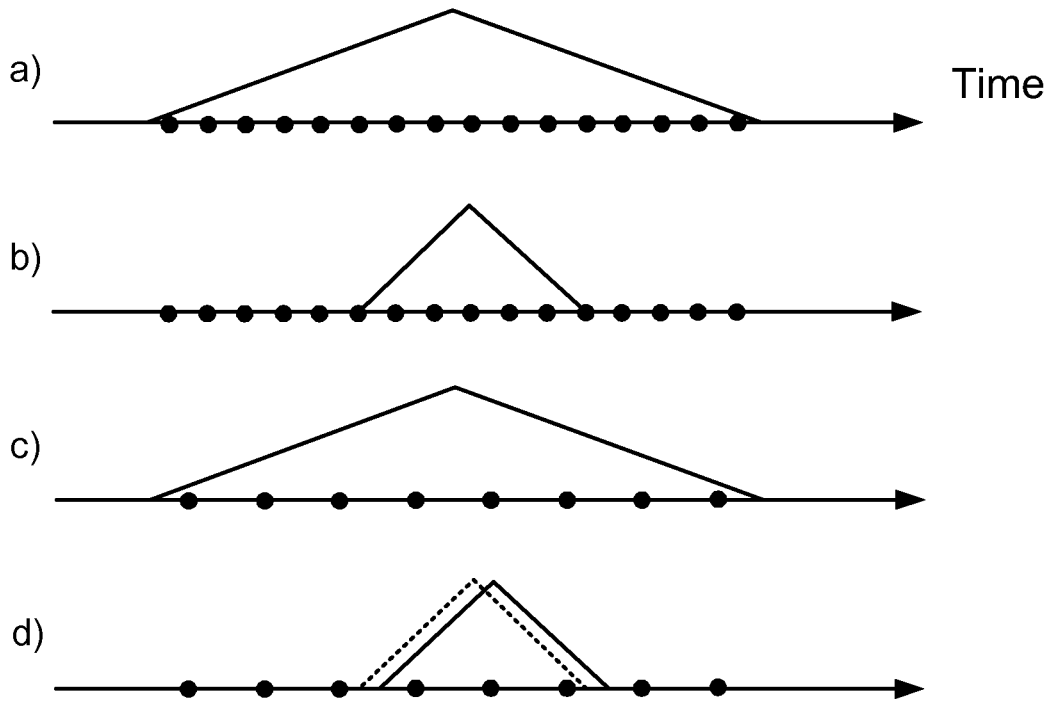
FIG. 4 illustrates a misalignment between windows of a first and a second filter bank.

Depending on which frequency representations are used, the sub-sampled operation of the transforms (i.e., using transforms of a reduced size, such as downsampled filters described above) may introduce a temporal delay. For example, if the first frequency domain representation is a MDCT and the second frequency domain representation is a QMF, there may be a misalignment of an even-symmetric inverse MDCT window and an odd-symmetric QMF window. This is further illustrated in FIG. 4. More specifically, there is a difference in delay of a fractional number of samples in the sub-sampled domain to be compensated for, in order to maintain synchronization with other branches of the signal chain. The reason for this is that the sample points of an MDCT are located on a shifted grid relative to the center of the window, whereas this may not be the case for a QMF bank. This is illustrated in FIG. 4 for the case of $q_2=2$.

FIG. 4*a* indicates the location of sample points relative to the MDCT window at the original sampling rate. FIG. 4*b* shows the corresponding situation for the QMF window. On the continuous time axis, this represents an example of the relative timing scenario for the full band applications of MDCT synthesis followed by QMF analysis. It is desirable that the sub-sampled operation conforms to the same relative timing. However, FIG. 4*c* indicates the location of the sample points relative to the MDCT window at the reduced sampling rate (as reduced by the sub-sampling factor of 2). The optimal continuous time position of the QMF analysis window is unchanged and depicted by the dashed window shape in FIG. 4*d*. But, as the available downscaled QMF analysis assumes sample points centered on the window, the best possible location of the discrete time analysis window is as depicted by the solid window shape of FIG. 4*d*. This introduces an additional delay of one quarter of a sample at the low sampling rate. In the general case the resulting timing error, referred to herein as the temporal delay, will be $d_{fract,2}=(q_2-1)/2$ samples at the original sampling rate. Fortunately, due to the typical appearance of QMF windows, the error can to a large extent be compensated by one, or a combination, of the following tools:

- A frequency varying phase gain factor following the QMF analysis. For example, a phase shift may be applied to the QMF subband samples as $\exp(-i*pi/La*d_{fract,2}*(k+0.5))$, where La is the current size of the analysis QMF bank and k=0 . . . La−1. This flavor of delay compensation introduces an inaudible albeit small phase error in the QMF reconstruction.
- A downsampled QMF analysis window which takes the temporal delay into account. This corresponds to using the dashed window of FIG. 4*d*.

A straightforward way of aligning the QMF window to identical time grid as the MDCT window is a linear downsampling of the QMF prototype filter in order to make the filter asymmetric. This may be done according to:

$$g(n) = (u-m)\cdot f(m+1) + (1+m-u)\cdot f(m),$$

$$n = 0, \ldots, \frac{N}{q_2} - 1$$

where N is the length of the original prototype filter f, $q_2$ is the subsampling factor, $u=n\cdot q_2+d_{fract,2}$ is a rational number and $m=\lfloor n \cdot q_2+d_{fract,2} \rfloor$ is an integer ($\lfloor \cdot \rfloor$ is the floor operator, i.e. the largest integer rounded downwards). The interpolated prototype filter g now has a generalized filter order $$o_g = \frac{o_f}{q_2} + \frac{1}{q_2} - 1,$$

where $o_f$ is the filter order of the original filter f. The reconstruction accuracy of the QMF analysis/synthesis chain is maintained by this operation. A consequence of the downsampling is a change of the prototype filter order (e.g. from an integer value $o_f$ to a rational number $o_g$). This must be reflected in the transform core, but can also be compensated for by applying a frequency dependent unity gain phase factor in the transform domain.

Adaptation of the reduced Nyquist frequency (or equivalently, the sub-sampling ratio) from frame to frame poses a challenge to transforms that rely on time domain samples from previous frames. This is for instance the case for the MDCT transform and the QMF bank which may be used as the frequency domain representation in the first and the second frequency domain, respectively. The reduction of the Nyquist frequency results in a different sampling rate of the intermediate time domain samples that are decoded from the current frame. These do not match the sampling rate of intermediate time domain samples from previous frames that are still stored in the system, and which need to be combined with the intermediate time domain samples of the current frame for further joint processing.

If this is the case, the transformation component 120 may re-sample the time domain samples from the previous frame(s). In more detail, the transformation component 120 may keep track of the, possibly reduced, value of the Nyquist frequency used in each frame. In particular, the transformation component 120 may check whether the value of the Nyquist frequency (the reduced value or the original value of the Nyquist frequency depending on whether or not a reduction has taken place in the frame) of the current frame and the previous frame are different. In this way, the transformation component 120 may identify if the current and the previous frame have different sampling rates. In case the transform requires time domain samples from a plurality of previous frames, the transformation component 120 may, in an analogous fashion, check if the value of the Nyquist frequency is different in the current frame and in any of the plurality of previous frames.

If the transformation component 120 finds that the current and the previous frame (or any of a plurality of previous frames) have different values of the Nyquist frequency, it may proceed to re-sample the intermediate time domain samples of the previous (or those of the previous frames which have a different value of the Nyquist frequency). The re-sampling is carried out such that the intermediate time domain samples of the current frame and the previous frame(s) have the same sampling rate.

This re-sampling may be achieved in different ways. For example, in order to have a re-sampling of high quality, traditional re-sampling using interpolation followed by low-pass filtering by a finite impulse response (FIR) filter, which in turn is followed by decimation, may be used. This is possible as long as the re-sampling concerns re-sampling by a rational factor (which is usually the case if the sub-sampling factors of the system are restricted to a limited set of integers or rational numbers as exemplified above). If sub-sampling by a factor of I/J is required, the transformation component 120 may first interpolate by a factor of J, followed by FIR-filtering, and then decimate by a factor of I.

As an alternative, linear or cubic spline interpolation without subsequent filtering may be used. This may result in a lower quality (e.g. there may be problems with aliasing), but has the advantage of a very low computational complexity. There may be a relative temporal delay introduced between the intermediate time domain samples of the current frame in relation to the intermediate time domain samples of the previous frame(s) due to a misalignment between windows (i.e. filters) of the first filter bank and the windows (i.e. filters) of the second filter bank. If the first filter bank is an MDCT filter bank, and the second filter bank is a QMF bank using an odd-symmetric prototype filter, the temporal delay between the intermediate time domain samples of the current frame in relation to the intermediate time domain samples of the previous frame(s) is related to the ratio $q_1$ between the sub-sampling factors of the current frame and the previous frame. In more detail, the relative temporal delay is given by a value $d_{fract,1}=(q_1-1)/2$. More generally, this would be the case if the first filter bank has a half sample symmetry, and the second filter bank has an integer sample symmetry as illustrated in FIG. 4*a* and FIG. 4*b*, respectively.

It is preferable to compensate for the relative temporal delay when re-sampling the previous frame(s), for example by temporally shifting the intermediate time domain samples of the previous frame by an amount corresponding to the temporal delay.

Having transformed the digital audio signal 102 from the first to the second frequency domain, the transformation component 120 may in step S12 proceed to restore the Nyquist frequency from its reduced value to the original value in the frame. This may be achieved by appending (empty) spectral bands to the digital audio signal in the second frequency domain above the reduced value of the Nyquist frequency $f_{N,red}$. This is further illustrated in FIG. 3*d*, where the empty spectral bands have been added to the frequency representation of the digital audio signal 102 in the second frequency domain such that the highest frequency represented is again given by the original value of the Nyquist frequency $f_N$.

The method described with reference to the flow chart of FIG. 2 thus allows different frames to have different reduced values of the Nyquist frequency, thereby adapting the Nyquist frequency to the spectral contents of each frame. In other words, the transformation component 120 may take a decision to switch the value of the reduced Nyquist frequency when going from the previous frame to the current frame. This decision may be taken only on basis of the spectral contents of the current frame. However, that may result in a jumping behavior of the reduced value of the Nyquist frequency, i.e., it may tend to change value very often. As a switch in the reduced value of the Nyquist frequency likely will require a downsampling of filters and/or re-sampling of intermediate time domain samples, it may be desirable to have more sparse transitions of the reduced value of the Nyquist frequency.

For that reason, the transformation component 120 may, when setting the reduced value of the Nyquist frequency of the current frame, in step S08, also take into account the reduced value of the Nyquist frequency of the previous frame in relation to the frequency range of the current frame. This is further illustrated in FIGS. 5 and 6.

Figure 5:
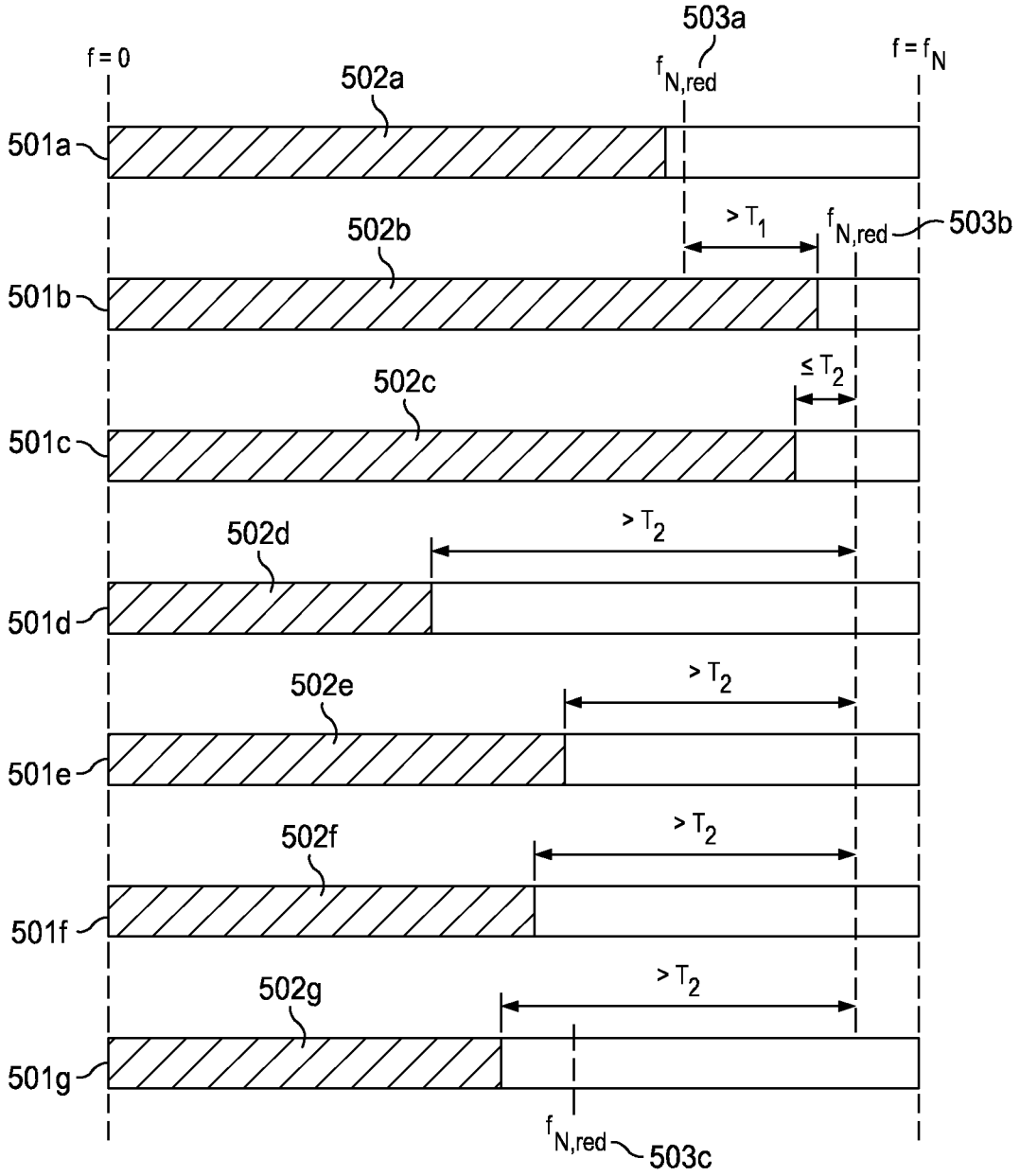
FIG. 5 illustrates a sequence of frames of a digital audio signal.

FIG. 5 illustrates seven consecutive frames 501*a*, 501*b*, 501*c*, 501*d*, 501*e*, 501*f*, 501*g*. Each frame 501*a-g* has a frequency range 502*a-g* (the dashed pattern of the frequency scale indicates non-zero spectral bands). Frame 501*a* is associated with a reduced value of the Nyquist frequency 503*a* (labeled by $f_{N,red}$). When the transformation component 120 receives the next frame 501*b*, the frequency range 502*b* of frame 501*b* is compared to the reduced value of the Nyquist frequency $f_{N,red}$ of the previous frame 501*a*. In this case, the frequency range 502*b* exceeds the reduced value of the Nyquist frequency 503*a* of the previous frame 501*a* by more than a threshold amount $T_1$. In order to avoid aliasing problems and a truncated bandwidth, the reduced value of the Nyquist frequency 503*b* of frame 501*b* is set to be larger than the reduced value of the Nyquist frequency 503*a* of frame 501*a*. In particular the reduced value of the Nyquist frequency 503*b* is set to a value above the frequency range 502*b* of frame 501*b*.

When the transformation component 120 receives the subsequent frame 501*c*, it compares the frequency range 502*c* of frame 501*c* to the reduced value of the Nyquist frequency 503*b* of frame 501*b*. In this example, it will find that the frequency range 502*c* differs from the reduced value of the Nyquist frequency 503*b* by no more than a threshold amount $T_2$. It will therefore decide to keep the reduced value of the Nyquist frequency 503*b* of frame 501*b* also in frame 501*c*. The threshold amount $T_2$ is typically larger than the threshold amount $T_1$, meaning that the transformation component 120 is more prone to increase the reduced value of the Nyquist frequency (in order to avoid aliasing and a truncated bandwidth) than to decrease the reduced value of the Nyquist frequency (which may be beneficial for reducing computational complexity).

Upon receiving the next frame, frame 501*d*, the transformation component 120 compares the frequency range 502*d* to the reduced value of the Nyquist frequency 503*b*. It will then find that the frequency range 502*d* is below the reduced value of the Nyquist frequency 503*b* by more than the threshold amount $T_2$, meaning that it could be beneficial to switch to a lower reduced value of the Nyquist frequency. According to some embodiments, the transformation component 120 would therefore switch to a lower reduced value of the Nyquist frequency in frame 501*d*. However, in the illustrated embodiment, the transformation component 120 will also take the frequency range of a number of previous frames into account when setting the reduced value of the Nyquist frequency in frame 501*d*. In the illustrated example, the transformation component 120 takes the frequency range of three preceding frames into account when setting the reduced value of the Nyquist frequency. Generally, the number of previous frames is a parameter which may be predefined in or input to the system. The number of previous frames may typically be in the range 2-6 frames. In other words, the transformation component 120 will check whether each of the frequency ranges 502*c*, 502*b*, 502*a* of the preceding frames 501*c*, 501*b*, 501*a* is below the reduced value of the Nyquist frequency 503*b* by more than the threshold amount $T_2$. Since this is not satisfied in the present example, the transformation component 120 decides to keep the reduced value of the Nyquist frequency 503*b* also in frame 501*d*.

The transformation component 120 then repeats this procedure for frames 501*e* and 501*f* with the same outcome as for frame 501*d*, and the reduced value of the Nyquist frequency 503*b* is kept also in frames 501*e* and 501*f*.

However, when processing frame 501*g* the transformation component 120 will come to a different conclusion. In more detail, the transformation component 120 will find that the frequency range 502*g* of frame 501*g* is below the reduced value of the Nyquist frequency 503*b* by more than the threshold amount $T_2$, and, in addition, that also each of the frequency ranges 502*f*, 502*e*, 502*d* of the three preceding frames 501*f*, 501*e*, 501*d* is below the reduced value of the Nyquist frequency 503*b* by more than the threshold amount $T_2$. As a consequence, the transformation component 120 decides to switch to a new, lower, reduced value of the Nyquist frequency 503*c*. In this way, one may avoid switching of the reduced value of the Nyquist frequency too often. For example, otherwise the reduced value of the Nyquist frequency would first have been decreased in frame 501*d* and then increased again in the following frame 501*e*.

Figure 6:
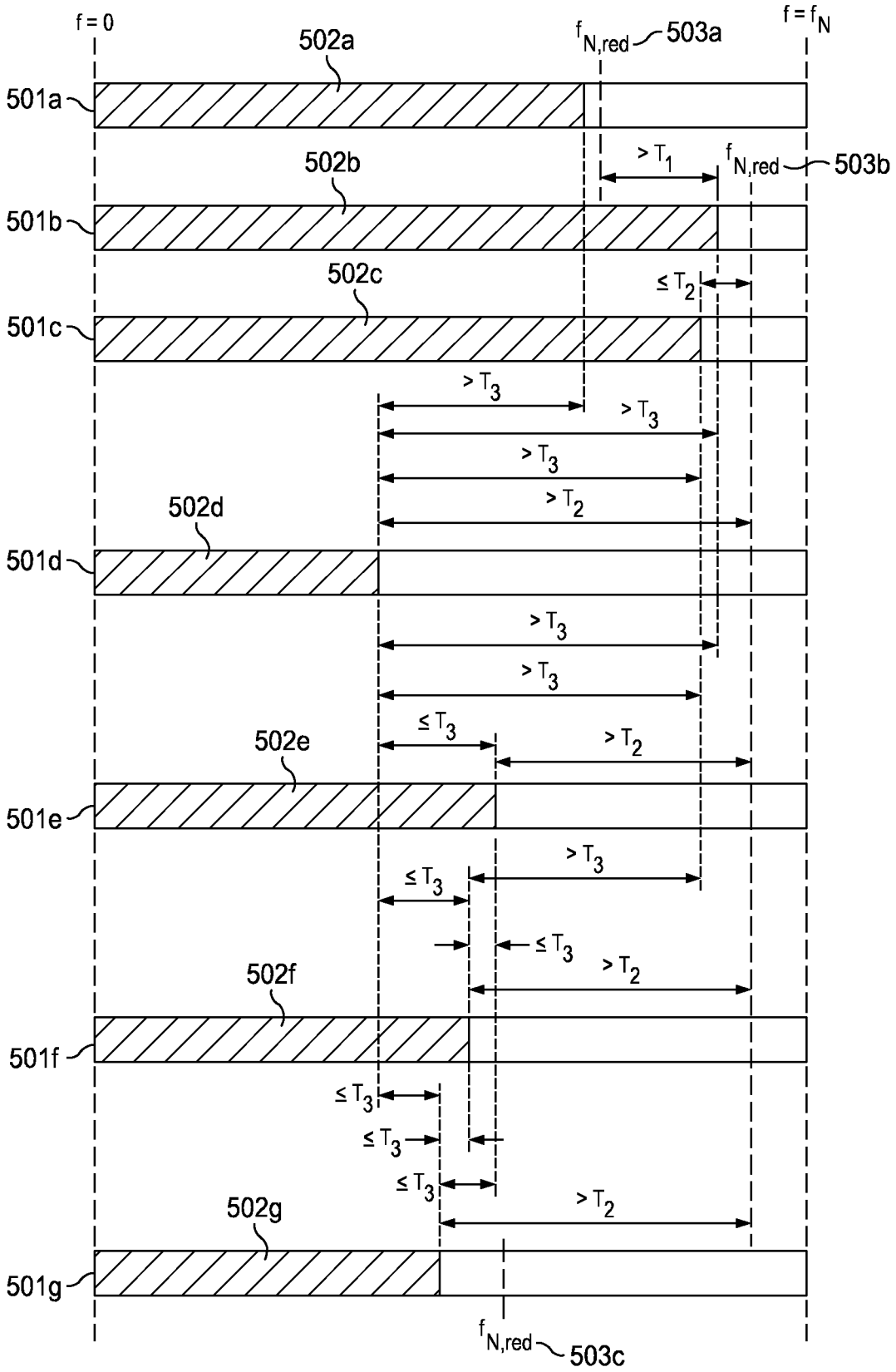
FIG. 6 also illustrates a sequence of frames of a digital audio signal.

FIG. 6 illustrates a variant which may be used as an alternative to, or in addition to, the embodiment of FIG. 5. The embodiment of FIG. 6 differs from the embodiment of FIG. 5 in that the transformation component 120 uses another decision criterion when switching to a lower reduced value of the Nyquist frequency. The processing of frames 501*a*, 501*b*, and 501*c* in the embodiments of FIGS. 5 and 6 is thus the same. However, this is not the case for frames 501*d*, 501*e*, 501*f*, and 501*g*.

Upon receiving frame 501*d*, the transformation component finds that the frequency range 502*d* is below the reduced value of the Nyquist frequency 503*b* of the previous frame by more than the threshold amount $T_2$. However, before deciding to switch to another, lower, reduced value of the Nyquist frequency, the transformation component will look at the frequency ranges of a number of preceding frames (in this case three preceding frames). In particular, the transformation component 120 checks whether each of the frequency ranges 502*c*, 502*b*, 502*a* of the three preceding frames differs from the frequency range 502*d* of the current frame 501*d* by no more than a threshold amount $T_3$ (which is typically smaller than $T_2$). In the illustrated example, this is not the case, and the transformation component 120 therefore decides to keep the reduced value of the Nyquist frequency 503*b* of the previous frame 501*c*.

The transformation component 120 repeats these checks also for subsequent frames 501*e* and 501*f* with the same outcome, namely that the reduced value of the Nyquist frequency 503*b* is kept also in frames 501*e* and 501*f*. However, when processing frame 501*g*, the transformation component 120 will come to another conclusion. Firstly, it will find that the frequency range 502*g* is below the reduced value of the Nyquist frequency 503*b* by more than the threshold amount $T_2$.

Secondly, it will find that each of the frequency ranges 502*f*, 502*e*, 502*d* of the three preceding frames 501*f*, 501*e*, 501*d* differs from the frequency range 502*g* of the current frame 501*g* by no more than the threshold amount $T_3$. As a consequence, the transformation component 120 takes a decision to switch to a new, lower, reduced value of the Nyquist frequency 503*c*.

Figure 7:
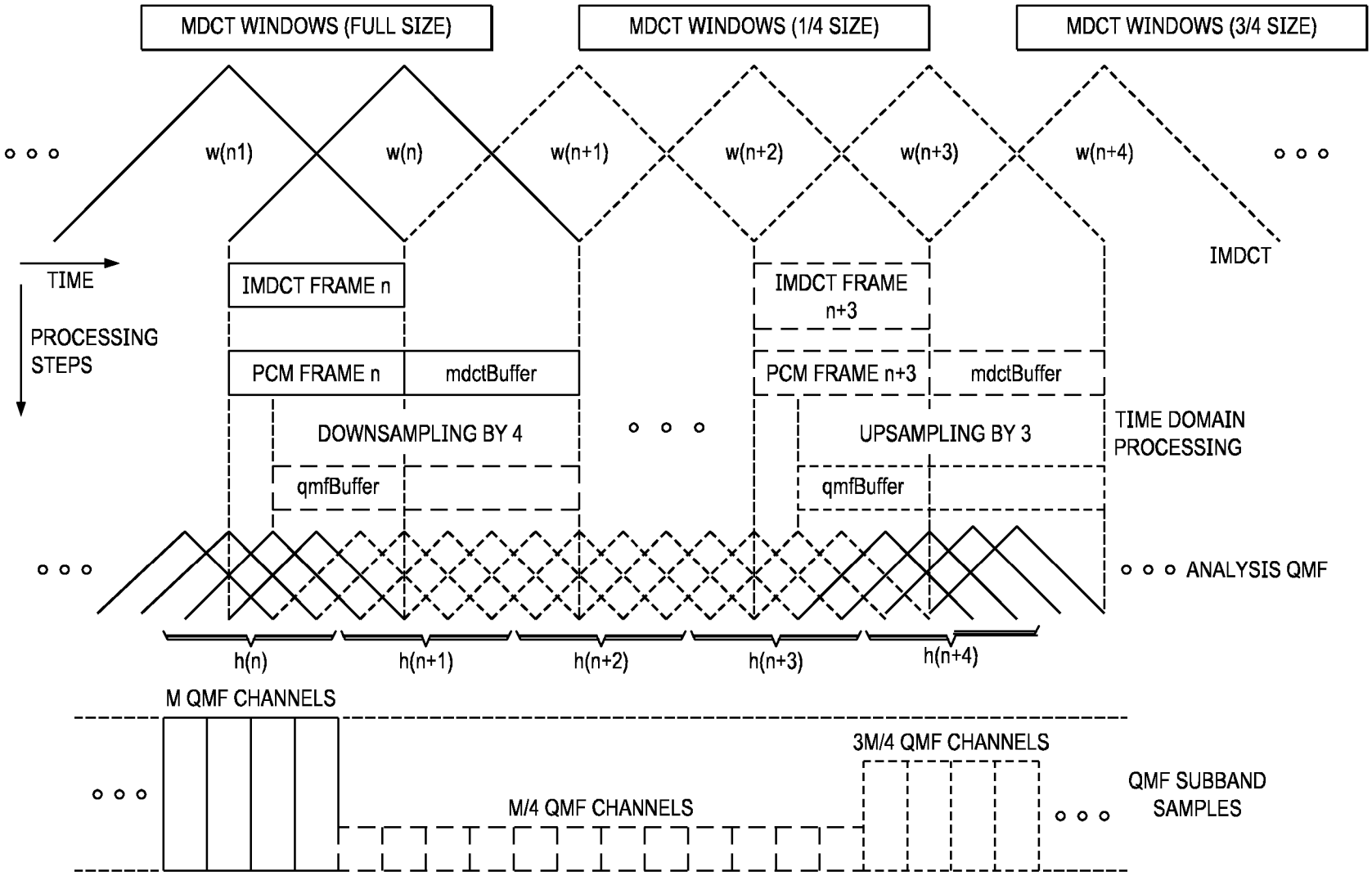
FIG. 7 illustrates a timing and buffer example according to an embodiment.

A practical example of how the transforming component 120 operates will now be disclosed in conjunction with FIG. 7. FIG. 7 shows a timing and buffer view when switching from subsampling factor 1 (no subsampling) to sub-sampling by a factor 4 and then up to 4/3. The height of the bars at the bottom of the figure indicate the amount of subsampling and hence the bandwidth of the subsampled system. Note that this example does not include the step of appending extra (empty) QMF bands above the current Nyquist frequency in order to restore the original bandwidth. The downsampling of the windows and time domain (PCM) buffers are represented by dotted lines (with lower "dot-pitch" for higher degree of subsampling). They all represent the same absolute duration in time, only the sample rate and hence bandwidth are different.

In frame n−1 and n, full size transforms are used. The time domain output from IMDCT frame n is fed into the PCM line and a PCM frame is fed to the analysis QMF bank (drawn with solid lines). In this constellation, four QMF blocks are processed (four solid line windows h(n)). The full bandwidth QMF output is shown as four solid bars at the bottom of the figure. In frame n+1, the bandwidth of the signal is much lower, and hence a ¼-size transform is adequate for transforming the MDCT coefficients without artifacts or truncated bandwidth. To adapt the time domain data from frame n to the subsampled data of frame n+1, the solid line buffer blocks of frame n need to be re-sampled. Hence the history buffer of the QMF qmfBuffer (N−L samples), and the IMDCT overlap-add buffer mdctBuffer, are downsampled by a factor 4. The result is stored in the dashed blocks and used by the IMDCT overlap-add process and the analysis QMF (M/4 channels) in frame n+1. After the re-sampling, the transforms may run on the new sub-sampled rate until there is a need to increase the bandwidth in frame n+4. At that instance, the time domain buffers from frame n+3 (dashed blocks on the right) are upsampled by a factor 3. The result is stored in the dotted blocks and is used in the IMDCT overlap-add process and in the analysis QMF bank using a ¾-size filter bank in frame n+4. Again, the resulting QMF samples are shown as dotted bars at the bottom of the figure.

The re-sampling of the buffers: the history buffer of the analysis QMF bank, and the overlap-add buffer of the inverse MDCT, can be made in one step since they are contiguous. A re-sampling of high quality can be done by traditional re-sampling involving interpolation and FIR-filtering, followed by decimation. An alternative is to use linear or higher order interpolation resulting in less quality of the re-sampling but having a very low computational complexity. As an example, the buffers are re-sampled using linear interpolation. Firstly, the buffers are concatenated as $$\begin{cases} h(n) = qmfBuffer(n), & 0 \le n < N - L \\ h(n + N - L) = mdctBuffer(n), & 0 \le n < frameLength \end{cases}$$

where N is the current length of the QMF prototype filter, L is the current number of QMF channels, and frameLength is the current frame length (and MDCT size). The concatenated buffer h is subsequently interpolated as:

$$\tilde{h}(n) = (u - m) \cdot h(m + 1) + (1 + m - u) \cdot h(m),$$
$$n = 0, \ldots, \frac{W}{q_1} - 1$$

where W=N−L+frameLength, $q_1$ is a relative subsampling factor, $u = n \cdot q_1 + d_{fract,1}$ is a rational number and $m = \lfloor n \cdot q_1 + d_{fract,1} \rfloor$ is an integer ($\lfloor \cdot \rfloor$ is the floor operator, i.e. the largest integer rounded downwards). $d_{fract,1}$ is the delay given by $$d_{fract,1} = \frac{q_1 - 1}{2}.$$

Note that $q_1$ in this context means the subsampling factor relative to the current amount of subsampling, i.e., the ratio of the sub-sampling factor of the current frame and the previous frame, and may thus have a value smaller than 1. The interpolated values are then fed back to the respective buffers as:

$$\begin{cases} qmfBuffer(n) = \tilde{h}(n), & 0 \le n < (N - L)/q_1 \\ mdctBuffer(n) = \tilde{h}(n + (N - L)/q_1), & 0 \le n < frameLength/q_1 \end{cases}$$

EQUIVALENTS, EXTENSIONS, ALTERNATIVES AND MISCELLANEOUS

Further embodiments of the present disclosure will become apparent to a person skilled in the art after studying the description above. Even though the present description and drawings disclose embodiments and examples, the disclosure is not restricted to these specific examples. Numerous modifications and variations can be made without departing from the scope of the present disclosure, which is defined by the accompanying claims. Any reference signs appearing in the claims are not to be understood as limiting their scope. Additionally, variations to the disclosed embodiments can be understood and effected by the skilled person in practicing the disclosure, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The systems and methods disclosed hereinabove may be implemented as software, firmware, hardware or a combination thereof. Generally, the "components" referred to herein may be implemented as circuitry. In a hardware implementation, the division of tasks between functional units referred to in the above description does not necessarily correspond to the division into physical units; to the contrary, one physical component may have multiple functionalities, and one task may be carried out by several physical components in cooperation. Certain components or all components may be implemented as software executed by a digital signal processor or microprocessor, or be implemented as hardware or as an application-specific integrated circuit. Such software may be distributed on computer readable media, which may comprise computer storage media (or non-transitory media) and communication media (or transitory media). As is well known to a person skilled in the art, the term computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by a computer. Further, it is well known to the skilled person that communication media typically embodies computer readable instructions, data structures, program modules or other data in a modulated data signal such as a carrier wave or other transport mechanism and includes any information delivery media.

Various aspects of the present invention may be appreciated from the following enumerated example embodiments (EEEs):

EEE 1. A method in an audio decoder for transforming a digital audio signal from a first frequency domain to a second frequency domain, comprising:

receiving subsequent frames of a digital audio signal being represented in a first frequency domain, the digital audio signal having a Nyquist frequency which is half of an original sampling rate of the digital audio signal, for each frame of the digital audio signal:

identifying a frequency range of the digital audio signal by analyzing spectral contents of the digital audio signal, if the frequency range is below the Nyquist frequency by more than a threshold amount, lowering the Nyquist frequency of the digital audio signal from its original value to a reduced value by removing spectral bands of the digital audio signal above the identified frequency range, transforming the digital audio signal from the first frequency domain to a second frequency domain via an intermediate time domain, wherein the digital audio signal has a sampling rate in the intermediate time domain which is reduced in relation to the original sampling rate by a sub-sampling factor defined by a ratio between the original value of the Nyquist frequency and the reduced value of the Nyquist frequency, and appending spectral bands to the digital audio signal in the second frequency domain above the reduced value of the Nyquist frequency so as to restore the Nyquist frequency to its original value.

EEE 2. The method of EEE 1, wherein the reduced value of the Nyquist frequency of a current frame is set depending on the reduced value of the Nyquist frequency of a previous frame in relation to the frequency range of the current frame.

EEE 3. The method of EEE 2, wherein the reduced value of the Nyquist frequency of the current frame is set to be larger than the reduced value of the Nyquist frequency of the previous frame if the frequency range of the current frame exceeds the reduced value of the Nyquist frequency of the previous frame by more than a threshold amount.

EEE 4. The method of EEE 2 or 3, wherein the reduced value of the Nyquist frequency of the current frame is set to be equal to the reduced value of the Nyquist frequency of the previous frame if a highest frequency of the frequency range of the current frame differs from the reduced value of the Nyquist frequency of the previous frame by no more than a threshold amount.

EEE 5. The method of any one of EEEs 2-4, wherein the reduced value of the Nyquist frequency of the current frame is set to be lower than the reduced value of the Nyquist frequency of the previous frame if the frequency range of the current frame is below the reduced value of the Nyquist frequency of the previous frame by more than a threshold amount.

EEE 6. The method of any one of EEEs 2-5, wherein the reduced value of the Nyquist frequency of the current frame is further set depending on the frequency range of a predefined number of previous frames.

EEE 7. The method of EEE 6, wherein the reduced value of the Nyquist frequency of the current frame is set to be lower than the reduced value of the Nyquist frequency of the previous frame if, additionally, the absolute values of the differences between the frequency range of the current frame and each of a predefined number of previous frames are each no more than a threshold amount.

EEE 8. The method of EEE 6, wherein the reduced value of the Nyquist frequency of the current frame is set to be lower than the reduced value of the Nyquist frequency of the previous frame if, additionally, the frequency range of each of a predefined number of previous frames is below the reduced value of the Nyquist frequency of the previous frame by more than a threshold amount.

EEE 9. The method of any one of the preceding EEEs, wherein transformation of the digital audio signal from the first frequency domain to the intermediate time domain or from the intermediate time domain to the second frequency domain requires intermediate time domain samples of the digital audio signal from a previous frame, in addition to intermediate time domain samples of the digital audio signal from a current frame, the method further comprising:

checking if the reduced value of the Nyquist frequency is different in the current frame and the previous frame so as to identify if the intermediate time domain samples of the digital audio signal in the current and the previous frame have different sampling rates, and if so, re-sampling of the intermediate time domain samples of the previous frame such that the intermediate time domain samples in the current frame and the previous frame have the same sampling rate.

EEE 10. The method of EEE 9, wherein the re-sampling comprises compensating for a temporal delay being due to a temporal misalignment of filters of a first bank of filters, used to transform the digital audio signal from the first frequency domain to the intermediate time domain, and filters of a second bank of filters used to transform the digital audio signal from the intermediate time domain to the second frequency domain.

EEE 11. The method of EEE 10, wherein the temporal delay is given by a value $d_{fract,1}$ which depends on a ratio $q_1$ between the sub-sampling factors of the current frame and the previous frame, respectively, according to $d_{fract,1}=(q_1-1)/2$.

EEE 12. The method of any one of EEEs 9-11, wherein the intermediate time domain samples of the previous frame are re-sampled using interpolation, such as linear or cubic spline interpolation.

EEE 13. The method of any one of EEEs 9-11, wherein the intermediate time domain samples of the previous frame are re-sampled using interpolation and FIR-filtering followed by decimation.

EEE 14. The method of any one of the preceding EEEs, wherein the first frequency domain is associated with a first bank of synthesis filters having a first, predetermined, length, the second frequency domain is associated with a second bank of analysis filters having a second, predetermined, length, and the step of transforming the digital audio signal from the first frequency domain to a second frequency domain via an intermediate time domain comprises:

reducing the length of the synthesis filters of the first bank by the sub-sampling factor and using the synthesis filters of reduced length when transforming the digital audio signal from the first frequency domain to the intermediate time domain, and reducing the length of the analysis filters of the second bank by the sub-sampling factor and using the analysis filters of reduced length when transforming the digital audio signal from the intermediate time domain to the second frequency domain.

EEE 15. The method of EEE 14, wherein the length of the synthesis filters of the first bank is reduced by downsampling by the sub-sampling factor or by re-calculating the synthesis filters from a closed form expression describing the synthesis filters of the first bank.

EEE 16. The method of EEE 14 or 15, wherein the length of the analysis filters of the second bank is reduced by downsampling by the sub-sampling factor or by re-calculating the analysis filters from a closed form expression describing the analysis filters of the second bank.

EEE 17. The method of EEE 15 or 16, wherein the downsampling of the synthesis filters of the first bank and/or the analysis filters of the second bank comprises compensating for a temporal delay being due to a temporal misalignment of the synthesis filters of the first bank, and the analysis filters of the second filter bank.

EEE 18. The method of any one of EEEs 14-16, further comprising: applying a phase-shift to the digital audio signal after the step of transforming the digital audio signal from the first frequency domain to a second frequency domain via an intermediate time domain, wherein the phase-shift depends on a temporal delay being due to a temporal misalignment of the synthesis filters of the first bank, and the analysis filters of the second filter bank.

EEE 19. The method of EEE 17 or 18, wherein the temporal delay is given by a value $d_{fract,2}$ which depends on the sub-sampling factor according to $d_{fract,2}=(q_2-1)/2$, where $q_2$ is the sub-sampling factor.

EEE 20. The method of any one of EEEs 15-19, wherein the synthesis filters in the first bank and/or the analysis filters in the second bank are downsampled using linear or cubic spline interpolation.

EEE 21. The method of any one of the preceding EEEs, wherein the first frequency domain is a modified discrete cosine transform (MDCT) domain, and the second frequency domain is a quadrature mirror filter (QMF) domain.

EEE 22. The method of any one of the preceding EEEs, further comprising receiving parameters relating to the digital audio signal, wherein the frequency range is further identified based on the parameters.

EEE 23. The method of any one of the preceding EEEs, wherein the step of lowering the Nyquist frequency of the digital audio signal further comprises:

selecting, from a predefined set of values, a reduced value of the Nyquist frequency as the lowest value in the predefined set being above the identified frequency range, and removing spectral bands of the digital audio signal above the selected reduced value of the Nyquist frequency.

EEE 24. The method of any one of the preceding EEEs, wherein the digital audio signal has a plurality of audio channels, and wherein the steps of identifying a frequency range of the digital audio signal and lowering the Nyquist frequency are performed for each audio channel, thereby allowing different audio channels to have different reduced values of the Nyquist frequency in the same frame.

EEE 25. A computer program product comprising a computer-readable medium having computer code instructions stored thereon for carrying out the method of any one of the preceding EEEs when executed by a device having processing capability.

EEE 26. An audio decoder for transforming a digital audio signal from a first frequency domain to a second frequency domain, comprising:

a receiving component configured to receive subsequent frames of a digital audio signal being represented in a first frequency domain, the digital audio signal having a Nyquist frequency which is half of an original sampling rate of the digital audio signal, and a transformation component configured to, for each frame of the digital audio signal:

identify a frequency range of the digital audio signal by analyzing spectral contents of the digital audio signal, if the frequency range is below the Nyquist frequency by more than a threshold amount, lower the Nyquist frequency of the digital audio signal from its original value to a reduced value by removing spectral bands of the digital audio signal above the identified frequency range, transform the digital audio signal from the first frequency domain to a second frequency domain via an intermediate time domain, wherein the digital audio signal has a sampling rate in the intermediate time domain which is reduced in relation to the original sampling rate by a sub-sampling factor defined by a ratio between the original value of the Nyquist frequency and the reduced value of the Nyquist frequency, and append spectral bands to the digital audio signal in the second frequency domain above the reduced value of the Nyquist frequency so as to restore the Nyquist frequency to its original value.

The invention claimed is:

1. A method in an audio decoder for transforming a digital audio signal from a first frequency domain to a second frequency domain, comprising:

receiving subsequent frames of a digital audio signal being represented in a first frequency domain, the digital audio signal having a Nyquist frequency which is half of an original sampling rate of the digital audio signal, for each frame of the digital audio signal:

identifying an upper limit of a frequency range of said frame of the digital audio signal by analyzing spectral contents of said frame of the digital audio signal, wherein the upper limit is determined as the highest frequency having a non-zero spectral content within said frame, if the upper limit of the frequency range is below the Nyquist frequency by more than a threshold amount, lowering the Nyquist frequency of said frame of the digital audio signal from its original value to a reduced value by removing spectral bands of said frame of the digital audio signal above the identified upper limit of the frequency range, transforming said frame of the digital audio signal from the first frequency domain to a second frequency domain via an intermediate time domain, wherein said frame of the digital audio signal has a sampling rate in the intermediate time domain which is reduced in relation to the original sampling rate by a sub-sampling factor defined by a ratio between the original value of the Nyquist frequency and the reduced value of the Nyquist frequency, and appending spectral bands to said frame of the digital audio signal in the second frequency domain above the reduced value of the Nyquist frequency so as to restore the Nyquist frequency to its original value.

2. The method of claim 1, wherein the reduced value of the Nyquist frequency of a current frame is set depending on the reduced value of the Nyquist frequency of a previous frame in relation to the upper limit of the frequency range of the current frame.

3. The method of claim 2, wherein the reduced value of the Nyquist frequency of the current frame is set to be larger than the reduced value of the Nyquist frequency of the previous frame if the upper limit of the frequency range of the current frame exceeds the reduced value of the Nyquist frequency of the previous frame by more than a threshold amount; and/or wherein the reduced value of the Nyquist frequency of the current frame is set to be equal to the reduced value of the Nyquist frequency of the previous frame if the upper limit of the frequency range of the current frame differs from the reduced value of the Nyquist frequency of the previous frame by no more than a threshold amount; and/or wherein the reduced value of the Nyquist frequency of the current frame is set to be lower than the reduced value of the Nyquist frequency of the previous frame if the upper limit of the frequency range of the current frame is below the reduced value of the Nyquist frequency of the previous frame by more than a threshold amount.

4. The method of claim 2, wherein the reduced value of the Nyquist frequency of the current frame is further set depending on the upper limit of the frequency range of a predefined number of previous frames.

5. The method of claim 4, wherein the reduced value of the Nyquist frequency of the current frame is set to be lower than the reduced value of the Nyquist frequency of the previous frame if, additionally, the absolute values of the differences between the upper limit of the frequency range of the current frame and each of a predefined number of previous frames are each no more than a threshold amount; or wherein the reduced value of the Nyquist frequency of the current frame is set to be lower than the reduced value of the Nyquist frequency of the previous frame if, additionally, the upper limit of the frequency range of each of a predefined number of previous frames is below the reduced value of the Nyquist frequency of the previous frame by more than a threshold amount.

6. The method of claim 1, wherein transformation of a current frame of the digital audio signal from the first frequency domain to the intermediate time domain or from the intermediate time domain to the second frequency domain requires intermediate time domain samples of the digital audio signal from a previous frame, in addition to intermediate time domain samples of the digital audio signal from the current frame, the method further comprising:

checking if the reduced value of the Nyquist frequency is different in the current frame and the previous frame so as to identify if the intermediate time domain samples of the digital audio signal in the current and the previous frame have different sampling rates, and if so, re-sampling of the intermediate time domain samples of the previous frame such that the intermediate time domain samples in the current frame and the previous frame have the same sampling rate.

7. The method of claim 6, wherein the re-sampling comprises compensating for a temporal delay being due to a temporal misalignment of filters of a first bank of filters, used to transform the digital audio signal from the first frequency domain to the intermediate time domain, and filters of a second bank of filters used to transform the digital audio signal from the intermediate time domain to the second frequency domain.

8. The method of claim 7, wherein the temporal delay is given by a value $d_{fract,1}$ which depends on a ratio $q_1$ between the sub-sampling factors of the current frame and the previous frame, respectively, according to $d_{fract,1}=(q_1-1)/2$.

9. The method of claim 6, wherein the intermediate time domain samples of the previous frame are re-sampled using interpolation, such as linear or cubic spline interpolation; or wherein the intermediate time domain samples of the previous frame are re-sampled using interpolation and FIR-filtering followed by decimation.

10. The method of claim 1, wherein the first frequency domain is associated with a first bank of synthesis filters having a first, predetermined, length, the second frequency domain is associated with a second bank of analysis filters having a second, predetermined, length, and the step of transforming said frame of the digital audio signal from the first frequency domain to a second frequency domain via an intermediate time domain comprises:

reducing the length of the synthesis filters of the first bank by the sub-sampling factor and using the synthesis filters of reduced length when transforming said frame of the digital audio signal from the first frequency domain to the intermediate time domain, and reducing the length of the analysis filters of the second bank by the sub-sampling factor and using the analysis filters of reduced length when transforming said frame of the digital audio signal from the intermediate time domain to the second frequency domain.

11. The method of claim 10, wherein the length of the synthesis filters of the first bank is reduced by downsampling by the sub-sampling factor or by re-calculating the synthesis filters from a closed form expression describing the synthesis filters of the first bank.

12. The method of claim 10, wherein the length of the analysis filters of the second bank is reduced by downsampling by the sub-sampling factor or by re-calculating the analysis filters from a closed form expression describing the analysis filters of the second bank.

13. The method of claim 11, wherein the downsampling of the synthesis filters of the first bank and/or the analysis filters of the second bank comprises compensating for a temporal delay being due to a temporal misalignment of the synthesis filters of the first bank, and the analysis filters of the second filter bank.

14. The method of claim 10, further comprising:

applying a phase-shift to said frame of the digital audio signal after the step of transforming said frame of the digital audio signal from the first frequency domain to a second frequency domain via an intermediate time domain, wherein the phase-shift depends on a temporal delay being due to a temporal misalignment of the synthesis filters of the first bank, and the analysis filters of the second filter bank.

15. The method of claim 13, wherein the temporal delay is given by a value $d_{fract,2}$ which depends on the sub-sampling factor according to $d_{fract,2}=(q_2-1)/2$, where $q_2$ is the sub-sampling factor.

16. The method of claim 11, wherein the synthesis filters in the first bank and/or the analysis filters in the second bank are downsampled using linear or cubic spline interpolation.

17. The method of claim 1, wherein the first frequency domain is a modified discrete cosine transform (MDCT) domain, and the second frequency domain is a quadrature mirror filter (QMF) domain; and/or further comprising receiving parameters relating to the digital audio signal, wherein the upper limit of the frequency range is further identified based on the parameters; and/or wherein the digital audio signal has a plurality of audio channels, and wherein the steps of identifying an upper limit of the frequency range of said frame of the digital audio signal and lowering the Nyquist frequency are performed for each audio channel, thereby allowing different audio channels to have different reduced values of the Nyquist frequency in the same frame.

18. The method of claim 1, wherein the step of lowering the Nyquist frequency of said frame of the digital audio signal further comprises:

selecting, from a predefined set of values, a reduced value of the Nyquist frequency as the lowest value in the predefined set being above the identified upper limit of the frequency range, and removing spectral bands of said frame of the digital audio signal above the selected reduced value of the Nyquist frequency.

19. A computer program product having instructions which, when executed by a computing device or system, cause said computing device or system to perform the method according to claim 1.

20. An audio decoder for transforming a digital audio signal from a first frequency domain to a second frequency domain, comprising:

a receiving component configured to receive subsequent frames of a digital audio signal being represented in a first frequency domain, the digital audio signal having a Nyquist frequency which is half of an original sampling rate of the digital audio signal, and a transformation component configured to, for each frame of the digital audio signal:

identify an upper limit of a frequency range of said frame of the digital audio signal by analyzing spectral contents of said frame of the digital audio signal, if the upper limit of the frequency range is below the Nyquist frequency by more than a threshold amount, lower the Nyquist frequency of said frame of the digital audio signal from its original value to a reduced value by removing spectral bands of said frame of the digital audio signal above the identified upper limit of the frequency range, transform said frame of the digital audio signal from the first frequency domain to a second frequency domain via an intermediate time domain, wherein said frame of the digital audio signal has a sampling rate in the intermediate time domain which is reduced in relation to the original sampling rate by a sub-sampling factor defined by a ratio between the original value of the Nyquist frequency and the reduced value of the Nyquist frequency, and append spectral bands to said frame of the digital audio signal in the second frequency domain above the reduced value of the Nyquist frequency so as to restore the Nyquist frequency to its original value.

* * * * *